US005488390A

United States Patent [19]

Reinert et al.

[11] Patent Number: 5,488,390

[45] Date of Patent: Jan. 30, 1996

[54] APPARATUS, SYSTEMS AND METHODS FOR DISPLAYING A CURSOR ON A DISPLAY SCREEN

[75] Inventors: Christopher L. Reinert; Sudhir Sharma, both of Plano, Tex.

[73] Assignee: Cirrus Logic, Inc., Fremont, Calif.

[21] Appl. No.: 98,844

[22] Filed: Jul. 29, 1993

[51] Int. Cl.[6] ..... G09G 3/02

[52] U.S. Cl. ..... 345/145; 345/157

[58] Field of Search ..... 345/145, 157, 345/118, 191, 189

[56] References Cited

U.S. PATENT DOCUMENTS

| | | | |
|---|---|---|---|
| 4,847,621 | 7/1989 | Colles . | |
| 4,849,745 | 7/1989 | Satou | 345/191 |
| 4,857,929 | 8/1989 | Katzenstein . | |
| 4,899,151 | 2/1990 | Colles . | |
| 4,904,922 | 2/1990 | Colles . | |
| 5,185,597 | 2/1993 | Pappas et al. | 345/145 |

OTHER PUBLICATIONS

"Session XIV: Data Acquisition and Conversion, THPM 14:6: A 60 ns Glitch–Free NMOS DAC," V. Shen, D. Hodges, 1983 IEEE International Solid–State Circuits Conference, pp. 188–189 Month ?.

"An 80–MHz 8–bit CMOS D/A Converter," T. Miki, Y. Nakamura, M. Nakaya, S. Asai, Y. Akasaka, Y. Horiba, IEEE Journal of Solid–State Circuits, vol. SC–21, No. 6, Dec. 1986, pp. 983–988.

*Primary Examiner*—Curtis Kuntz
*Assistant Examiner*—Vivian W. Chang
*Attorney, Agent, or Firm*—Winstead Sechrest & Minick

[57] ABSTRACT

A circuitry is provided for controlling the display of a window on a display operable to display information as at least one field of a plurality of lines of pixels. First counter circuitry is included which is operable to increment with each of a plurality of selected pixels of a given line. First storage circuitry stores position data representing a first coordinate of a reference pixel in the field, the reference pixel being associated with an area of the field in which the window is to be displayed. First adding circuitry is provided which is operable to add a count corresponding to a current pixel and output from the first counter to the position data in the first register. Second counter circuitry is also provided which is operable to increment with each line of the field. Second storage circuitry stores position data representing a second coordinate of the reference pixel. A count corresponding to the current pixel and output from the second counter is added to the position data in the second register by second adding circuitry. Comparative circuitry compares the output of the first adding circuitry and the output of the second adding circuitry and in response outputs an enable signal when the current pixel is within the area of the field in which the window is to be displayed.

37 Claims, 4 Drawing Sheets

APPARATUS, SYSTEMS AND METHODS FOR DISPLAYING A CURSOR ON A DISPLAY SCREEN

TECHNICAL FIELD OF THE INVENTION

The present invention relates in general to display systems and in particular to apparatus, systems and methods for displaying a cursor on a display screen.

CROSS-REFERENCE TO RELATED APPLICATIONS

The following copending and coassigned U.S. patent applications contain related material and are incorporated herein by reference:

U.S. patent application Ser. No. 08/099,083, Attorney Docket No. P3510-P07US, entitled "System And Method For Processing Multiple Received Signal Sources," filed concurrently herewith;

U.S. patent application Ser. No. 08/099,716, Attorney Docket No. P3510-P08US, entitled "System And Method For Displaying Multiple Data Screens To A Single Display Device," filed concurrently herewith;

U.S. patent application Ser. No. 08/099,223, Attorney Docket No. P3510-P10US, entitled "Method And System For Attaching Dynamic Control Codes To Received Real-Time Data Streams," filed concurrently herewith;

U.S. patent application Ser. No. 08/098,846, Attorney Docket No. P3510-P11US, entitled "A System And Method For The Mixing Of Graphics And Video Signals," filed concurrently herewith;

U.S. patent application Ser. No. 08/099,194, Attorney Docket No. P3510-P12US, entitled "Video Processing Apparatus, Systems And Methods," filed concurrently herewith;

U.S. patent application Ser. No. 08/099,835, Attorney Docket No. P3510-P13US, entitled "Method And System For Achieving Full Monotonic Signal Conversion," filed concurrently herewith;

U.S. patent application Ser. No. 08/099,158, Attorney Docket No. P3510-P14US, entitled "A Voltage Reference And Current Source For Video DAC," filed concurrently herewith; and U.S. patent application Ser. No. 08/098,840, Attorney Docket No. P3510-P16US entitled "Method and System for Generating Dynamic Zoom Codes," filed concurrently herewith.

BACKGROUND OF THE INVENTION

Computer users continue to demand increased performance from the computer systems available in the marketplace. Of particular interest have been computer systems with improved display subsystems which provide, among other things, color images, improved image definition, and windowing. Such improvements in display technology not only made the display screens more aesthetically pleasing to the user but also generally make the system easier to use, both important considerations when analyzing marketability.

Recent improvements in display technology have been directed at allowing display systems to manage and mix both graphics data and video data in a windowing environment. In addition to controlling the content of various sections (windows) of the display screen, these display systems must also establish compatibility between the display device (e.g., a raster scan display) and the graphics and video data sources. In the case of graphics data, the display control circuitry must be capable of driving a given display from data received from various sources (for example, VGA, CGA, VRAM) as well as in varying formats (for example, varying numbers of bits per pixel and/or varying numbers of bits per each color in a pixel). Similarly, in the case of video data, the display control circuitry must be capable of handling input data in varying formats, such as RGB and YUV, and of varying numbers of bits per pixel and/or bits per color. All these considerations must be made in view of the ever increasing data transfer speeds.

Many computer users, especially in a windowing environment, employ an on-screen cursor, typically controlled by a mouse, for information input and control. As a result, display system designers must further concern themselves with the generation of the cursor on the display. Some of the factors which must be considered are the user's desired positioning of the cursor on the screen, the overlay of the cursor above the incoming graphics and/or video data, and the relationship of the cursor to any bordering which may be desired around the periphery of the screen.

Thus, the need has arisen for improved apparatus, systems and methods for generating a cursor on a display screen. Such a cursor should be operable in multiple source and windowing environments operating at high speed. Further, the cursor should be operable when the display environment includes such characteristics as bordering and the like.

SUMMARY OF THE INVENTION

According to the invention, circuitry is provided for controlling the display of a window on a display operable to display information as at least one field of a plurality of lines of pixels. First counter circuitry is provided which is operable to increment with each of a plurality of selected pixels of a one of the lines. First storage circuitry stores position data representing a first coordinate of a reference pixel in the field, the reference pixel associated with an area of the field in which the window is to be displayed. First adding circuitry adds a count corresponding the current pixel and output from the first counter to the position data in the first register. Second counter circuitry is provided which is operable to increment with each line of the field. Second storage circuitry stores position data representing a second coordinate of the reference pixel. Second adding circuitry adds a count corresponding to the current pixel and output from the second counter to the position data in the second register. Finally, comparator circuitry is provided which compares the output of the first adding circuitry to the output of the second adding circuitry and in response outputs an enable signal when the current pixel is within the area of the field in which the window is to be displayed.

Display control apparatus, systems, and methods embodying the principles of the present invention provide distinct advantages over the prior art. In particular, the concepts of the present invention allow for the generation of a cursor in multiple source and windowing environments operating at high speed. Further, apparatus, systems, and methods according to the principles of the present invention allow for the generation of a cursor on a user-selected portion of the screen even when the display environment includes such characteristics as bordering and the like. Finally, according to the principles of the present invention, the user may select the shape of the cursor to be displayed, and alternate embodiments be size and shape of the pixel rate displaying the cursor can be altered.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The principles of the present invention and their advantages are best understood by referring to the illustrated embodiment depicted in FIGS. 1–4 of the drawings, in which like numbers designate like parts.

Figure 1:
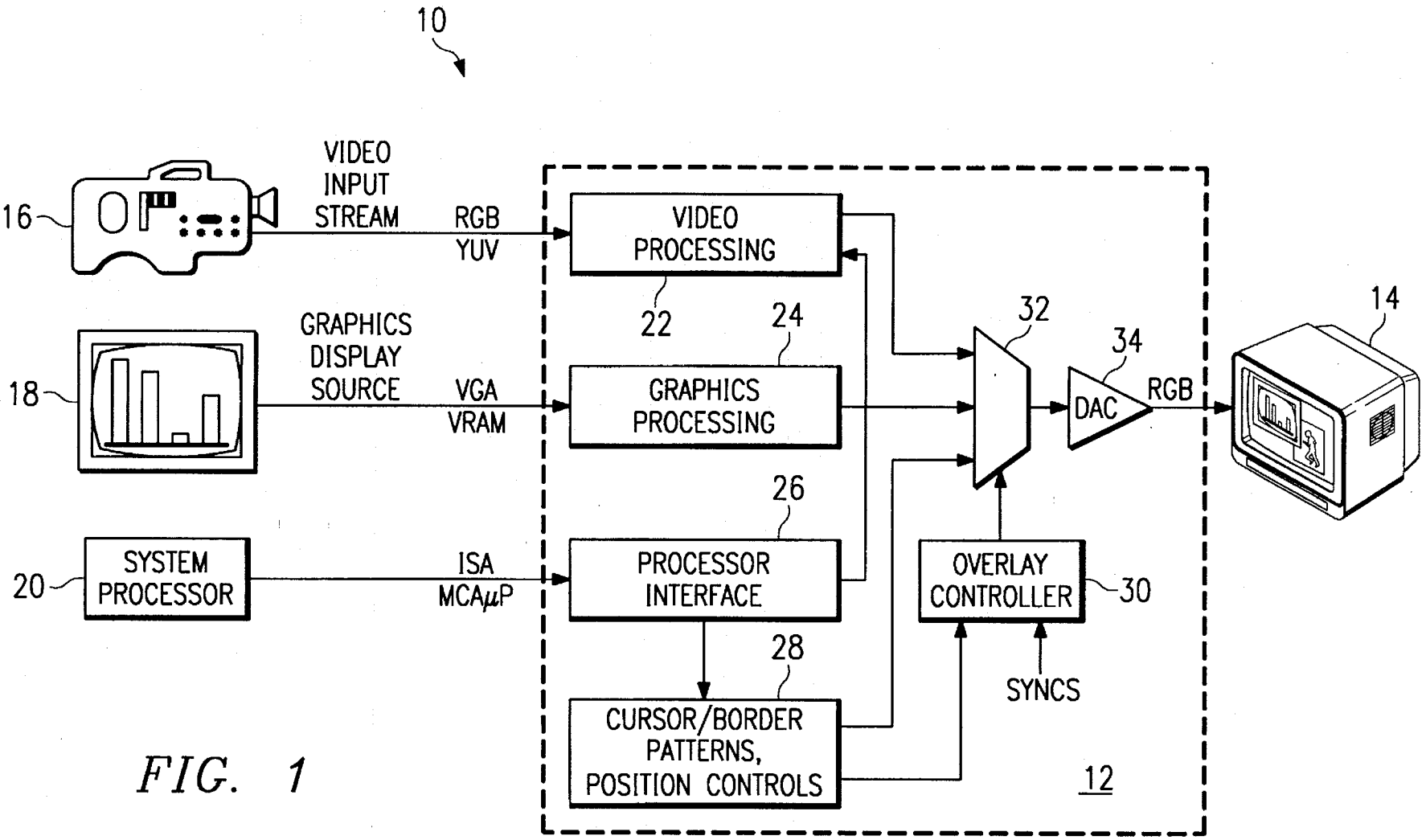
FIG. 1 is a functional block diagram of display system embodying the principles of the present invention.

FIG. 1 is a simplified block diagram of a display system 10. Display system 10 generally includes display control circuitry 12, a raster scan display unit 14, a video data source 16, a graphics data source 18, and a system processor 20. According to the illustrate embodiment of the present invention, display control circuitry 12 includes video processing circuitry 22, graphics processing circuitry 24, a processor interface 26, cursor/border pattern generation and position control circuitry (cursor/border control circuitry) 28 and overlay control circuitry 30. The outputs from video processing circuitry 22, graphics processing circuitry 24 and cursor/border control circuitry 28 are provided to the inputs of a multiplexer 32 which operates under the control of overlay control circuity 30. The output of multiplexer 32 is in turn provided to digital to analog converters 34 which generates the analog RGB signals which drive display unit 14.

Video processing circuitry 22 receives video data in any one of a number of RGB and YUV data formats, and under the control of system processor 20 (through interface 26) converts this video data into an RGB format suitable for driving display 14. In the illustrated embodiment, video processing circuitry 22 receives 32 bits, which may be for example, composed of a 24-bit words of RGB data in an 8:8:8 format (i.e., 8 bits each of red, green and blue color data), two 16-bit words of RGB data in a 5:6:5 format (i.e., 5 bits of red and blue data and 6 bits of green) or a pair of 16-bit words of YUV data in a 4:2:2 format (i.e., 4 bits of luminance, 2 bits each of red and blue chrominance). In the illustrated embodiment, video processing circuitry 22 outputs 24 bits of RGB color data in an 8:8:8 format to DACs 34. Video processing circuitry also performs chrominance interpolation, color-space conversion, and zoom control functions. For a more complete description of the operation of video processing circuitry 22, reference is now made to "CL-PX2080 Preliminary Data Sheet", December 1992, available from Pixel Semiconductor, Dallas, Tex., incorporated herein by reference.

Graphics processing circuitry 24 receives graphics data in any number of formats and provides in response RGB data to DACs 34 for driving display 14. For example, in the illustrated embodiment, graphics processing circuitry 24 may receive 8-bit VGA data or alternatively, 32-bit words of graphics data of either 4,8, or 16 bits per pixel from a video random access memory (VRAM) (not shown). In the illustrated embodiment, graphics processing circuitry 24 is operable to provide RGB data in an 8:8:8 format to DACs 34 in either a true color or a pseudocolor mode.

Processor interface 26 in the illustrated embodiment is operable to connect to the system processor 20 via direct connection to ISA bus, MCA bus, or to the local bus of the host processor 20. In addition to bus interfacing circuitry, processor interface 26 also contains the configuration, control and status registers of display control circuitry 12.

Overlay control circuitry 30 and multiplexer 32 allows for video data from video processing circuitry 22, graphics data from graphics processing circuitry 24 and/or cursor and border data from cursor/border control circuitry 28, to be combined to generate images on display 14. Each pixel of data provided at the inputs of multiplexer 32 is either transparent or opaque. Each pixel of graphics data is either opaque or transparent vis-a-vis the video data. If the graphics pixel is opaque, the corresponding graphics color data is used to drive display 14 (the video data is masked). If the graphics pixel is transparent, the color data for the video "behind it" is displayed on the screen. Overlay control circuitry determines which graphics pixels are transparent and which are opaque. The operation of multiplexing (mixing) circuitry 32 is described in detail in copending and coassigned U.S. patent application Ser. No. 08/098,846 (Attorney's Docket No. P3510-P11US), entitled "A System and Method for the Mixing of Graphics and Video Signals," and filed concurrently herewith, incorporated herein by reference.

In the illustrated embodiment, DACs 34 are three 8-bit digital to analog converters for respectively converting the 8 bits of red, green and blue color data received from multiplexer 32 into analog signals for driving the color screen of display 14.

For a more complete description of the operation of processor interface 26, graphics processing circuitry 24, overlay control circuitry 30, and DACs 34, reference is again made to the "CL-PX2080 Preliminary Data Sheet" cited above.

Cursor/border control circuitry generates, when desired, a border around the periphery of the screen of display 14 and a cursor which, depending on its position on the screen, overlays the input graphics and/or video color data. The cursor generation function according to the principles of the present invention, in view of the border generation feature, is generally described by the simplified functional block diagram of FIG. 2.

Figure 2:
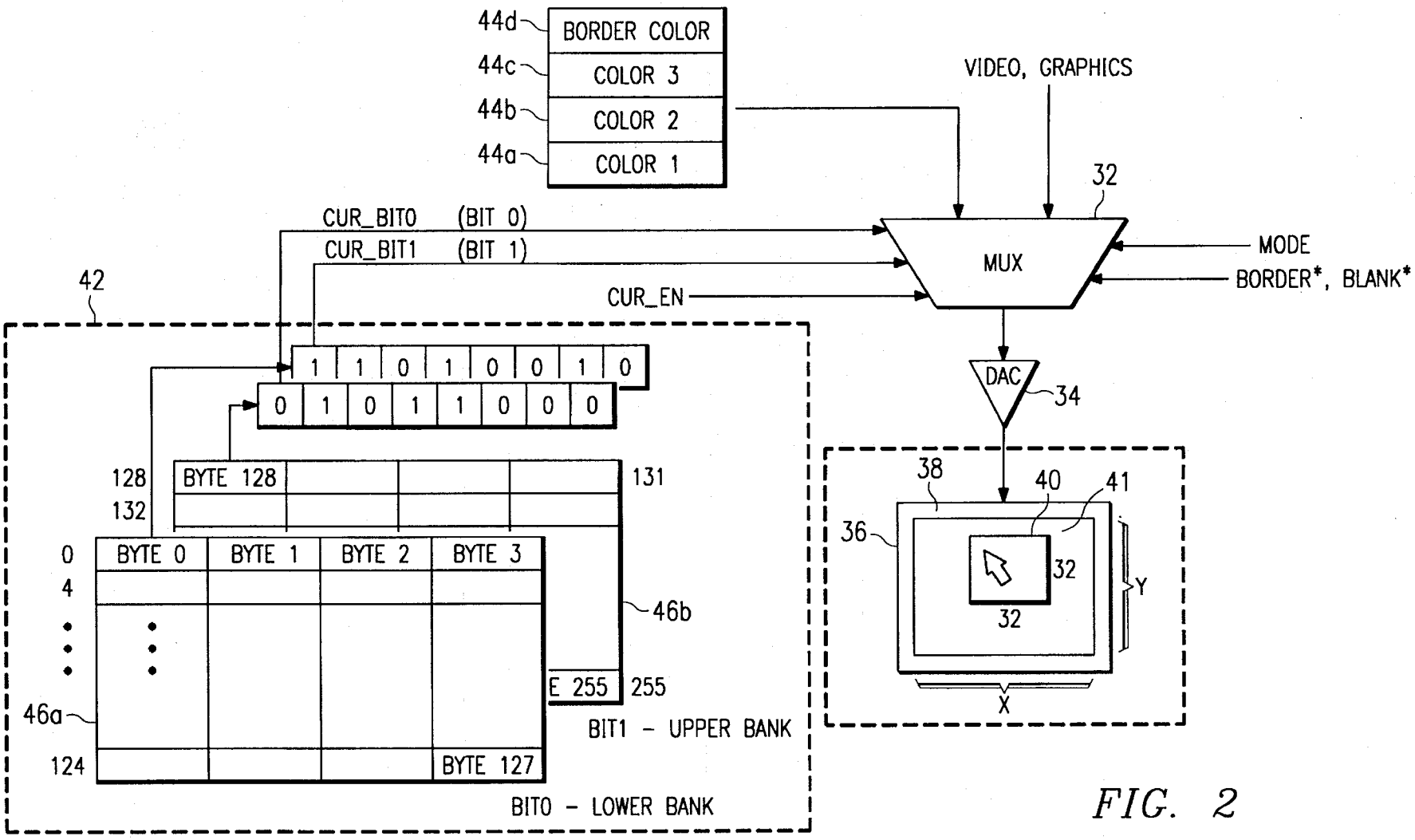
FIG. 2 is a more detailed functional block diagram of a preferred embodiment of a cursor generator embodying the principles of the present invention.

FIG. 2 is a more detailed functional block diagram of a cursor generation subsystem embodying the principles of the present invention. In FIG. 2, the screen 36 of display system 14 is shown in further detail with a border 38 being displayed around the periphery and a cursor 40 disposed at an arbitrary user selected position. In a preferred embodiment, display unit 14 is an RGB raster scan display with images displayed on screen 36 as a sequence of frames of lines of pixels updated with the raster scans. In the interleaved mode, each frame consists of odd and even fields of lines of pixels, the lines of one field being updated with the scan following each vertical synch. In the noninterleaved mode, each frame consists only of one field of lines of pixels, with all lines being updated with each scan following a vertical sync.

In the illustrated embodiment, cursor 40 is generated as a 32 by 32 array of pixels, although in alternate embodiments the pixel array may vary in size and shape. When border 38 is being displayed (BORDER* inactive or high), the "active window" 41 in which cursor 40 may be displayed is the array of pixels on display screen 36 within border 38. If a border 38 is not being displayed, the active window 41 in which cursor 40 may be displayed becomes the area (array of pixels) on screen 36 within the deactivated period of the display blanking signal BLANK*.

FIG. 2 also depicts a random access memory 42 and a plurality of color registers 44. Random access memory 42 stores an array of register select data words, in the illustrated embodiment each word consisting of two bits (CUR_BIT0, CUR-BIT1), which define a desired pattern for cursor 40. In the example shown in FIG. 2, the pattern or form of cursor 40 is an arrow, although a number of possible patterns can be generated through the loading of RAM 42. The register select words address color registers 44 which hold color data words defining possible colors for a given pixel in cursor 40. In the illustrated embodiment where cursor 40 is displayed as a 32 by 32 pixel array, RAM 42 has a 32 bit×32 bit by 2 plane architecture with each pixel in the 32×32 pixel array mapped to a corresponding location in each plane. For a given pixel in cursor 40, select word CUR_BIT0 is stored at a preselected location in PLANE 0 and select word CUR_BIT1 is stored at the same location in PLANE 1. As depicted in FIG. 2, bits CUR_BIT0 and CUR-BIT1 for eight pixels in the array of cursor 40 are stored together at a byte location, with two eight-bit bytes written in and retrieved with a single byte address. In the case of retrieval from RAM 42 for purposes of selecting a register 44, the pair of bits for the current pixel are then selected from the retrieved pair of bytes. Further, in the illustrated embodiment, each register 44 comprises three subregisters each for handling 8-bits each of red, blue and green color data for driving DACs 34.

In alternate embodiments, the size of the pixel array used display cursor 40 and the number of possible colors for a given pixel in that array may vary. In these embodiments, the architecture of RAM 42 and the number of color registers 44 will vary accordingly. For example. if cursor 40 is to be displayed as a 64 by 64 array of pixels, then RAM 42 may employ bit 64 by 64 bit planes which directly map to the pixel array. If additional colors are desired, additional color registers 44 may be used along with additional planes in RAM 42 to provide wider select words. For example, if an additional plane is added to RAM 42 such that three- bit wide select words are available, then up to eight color registers may be provided such a given pixel can be display as one of up to seven colors (border color register 44*a* being excluded).

As discussed further below in detail, cursor/border pattern circuitry 28 determines whether the current pixel being processed is within the area of the screen where the user wishes the cursor 40 to be displayed. When the current pixel does fall within the cursor 40 area, an enable signal CUR_EN is generated and provided to multiplexing circuitry 32. At the same time, an address to RAM 42 is generated to retrieve register select bits CUR_BIT0 and CUR_BIT1 from the RAM location mapping to the position of the current pixel in the cursor 40 pixel array. Bits CUR_BIT0 and CUR_BIT1 select the color register 44 and with CUR_EN active, the color data from the selected register 44 is passed by multiplexing circuitry 32 to the DACs 34.

Figure 3:
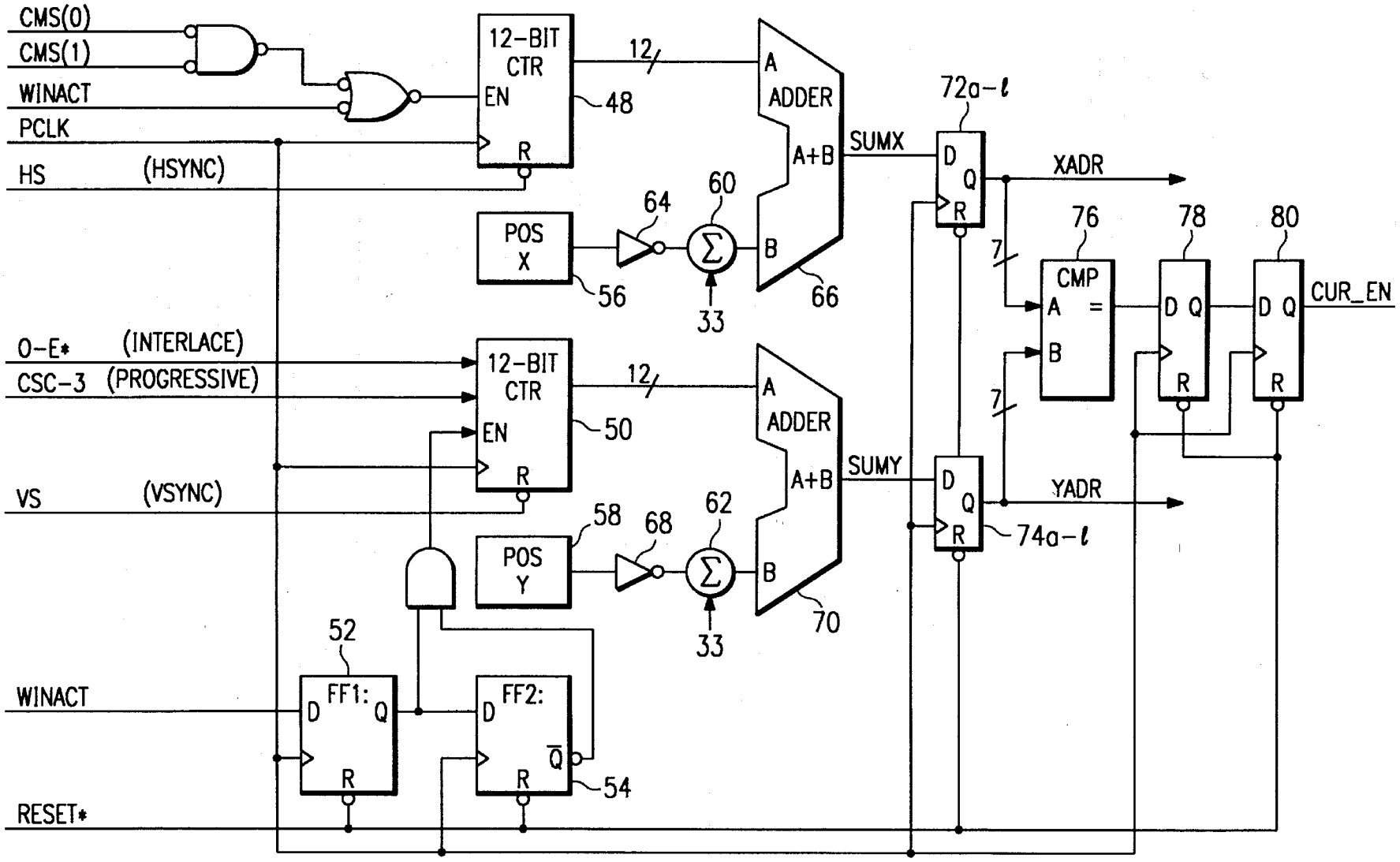
FIG. 3 is an electrical schematic diagram showing a first portion of the cursor generator of FIG. 2.

FIG. 3 depicts an embodiment of the circuitry for generating the cursor enabling signal (CUR_EN, FIG. 2) and addresses to RAM 42 for retrieval of the pairs of bits (CUR_BIT0, CUR_BIT1) for a given pixel in the cursor 40 pixel array. As an initial matter, the input signals will be briefly described. The horizontal sync (HS) and vertical sync (VS) signals are input from graphics display source 18 and time the generation of the display fields. A vertical sync (VS) pulse occurs at the start of the generation of color data for the pixels in each field to be displayed on display unit 14. A horizontal sync pulse indicates the start of the generation of color data for the pixels in each row of the current field. The pixel clock (PCLK) is also input from graphics display source 18 and clocks, along with its derivatives, the transfer of data through display control circuitry 12 to display unit 14. The active window signal (WINACT) occurs with each line of the current field being generated when BORDER* and BLANK* (display blanking) control signals are inactive and indicates that the current pixels fall within the active window 41 of the current field. The interlace (O-E*) and deinterlaced (progressive) (CSC-3) control signals indicate whether a deinterlaced or interlaced display 14 is being driven and if interlaced, whether the odd or even field is current. Similarly, control signals CMS(0) and CMS(1) are used for circuit control in the interlaced and noninterlaced display modes. The reset signal (RESET*) is used by the system to reset the pipelining, such as with a frame.

Two 12-bit counters 48 and 50 determine the position of the current pixel on screen 36. Specifically, counter 48 is used to determine the position of the current pixel along the current line of the field being generated (the x-position, see FIG. 2). Counter 48 is therefore enabled when the current pixel is in the active window (WINACT active) and is reset at the start of each new line in the current frame by the corresponding horizontal sync pulse. Counter 48 counts along the current line by counting the periods of the pixel clock (PCLK) which clocks the transfer of the color data through the system to display 14. Counter 50 is used to determine the current line of the frame being generated (the y-position, see FIG. 2). Counter 50 is reset with each new frame by the corresponding vertical sync pulse and is enabled, by flip-flops 52 and 54 for one PCLK period with each new WINACT active period corresponding to each new line. In essence, counter 50 tracks the current display line by counting the number of WINACT active periods during the current field following the corresponding vertical sync. When CSC-3 is active and the display 14 is being driven in a deinterlaced (progressive) mode, counter 50 counts by ones, in contrast to the interlace mode (CSC-3 inactive) during which counter 50 counts by twos. The O-E* signal designates whether an odd display field or an even display field such that the counting for the field corresponds to a start at the first pixel of line 0 (even fields) or the first pixel of line 1 (odd fields).

An x-position register 56 and a y-position register 58 hold position data, received through interface 26 from an input device (e.g., a mouse)(not shown), which indicates the user's desired position of cursor 40 on the display screen 36. In the illustrated embodiment, the position data in registers 56 and 58 references the top pixel in the top left corner of the cursor 40 pixel array. Summing circuits 60 and 62 in the illustrated embodiment add a selected number of bit to the data held in registers 56 and 58 to make an adjustment such that positioning is instead referenced from the pixel in the lower right hand corner of the pixel array of cursor 40.

The current count from the x-position counter 48 is added to the adjusted data from x-position register 56 (after inversion by inverter 64 which in actuality affects a twos complement subtraction) by adder 66. Similarly, the current count from the y-position counter 50 is added to the adjusted data from y-position register 58 (after inversion by inverter 68) by adder 70. The outputs of adders 66 and 70 are pipelined with the pixel clock with flip-flops 72*a*-1 and 74*a*-1 respectively.

The pipelined output of adder 66 (XADR) is used in part to address RAM 42, as discussed further below, and is also provided to a first input of a comparator 76. Similarly, pipelined sum (YADR) output from adder 70 is used in part to provide an address to RAM 42, also as discussed below, and is provided to a second input of comparator 76. In the illustrated embodiment, XADR is composed of 12 bits ($X_0$-$X_{11}$) with bits $X_5$-$X_{11}$ being designated the most significant bits (MSBs). Similarly, YADR is composed of 12 bits ($Y_0$-$Y_{11}$) of which bits $Y_5$-$Y_{11}$ are designated the MSBs. When the designated MSBs of both the XADR and the YADR signals are all equal to zero, cursor enable occurs and CUR-EN is output from comparator 76. Three flip-flops 78–82 pipeline CUR-EN with the pixels clock.

Figure 4:
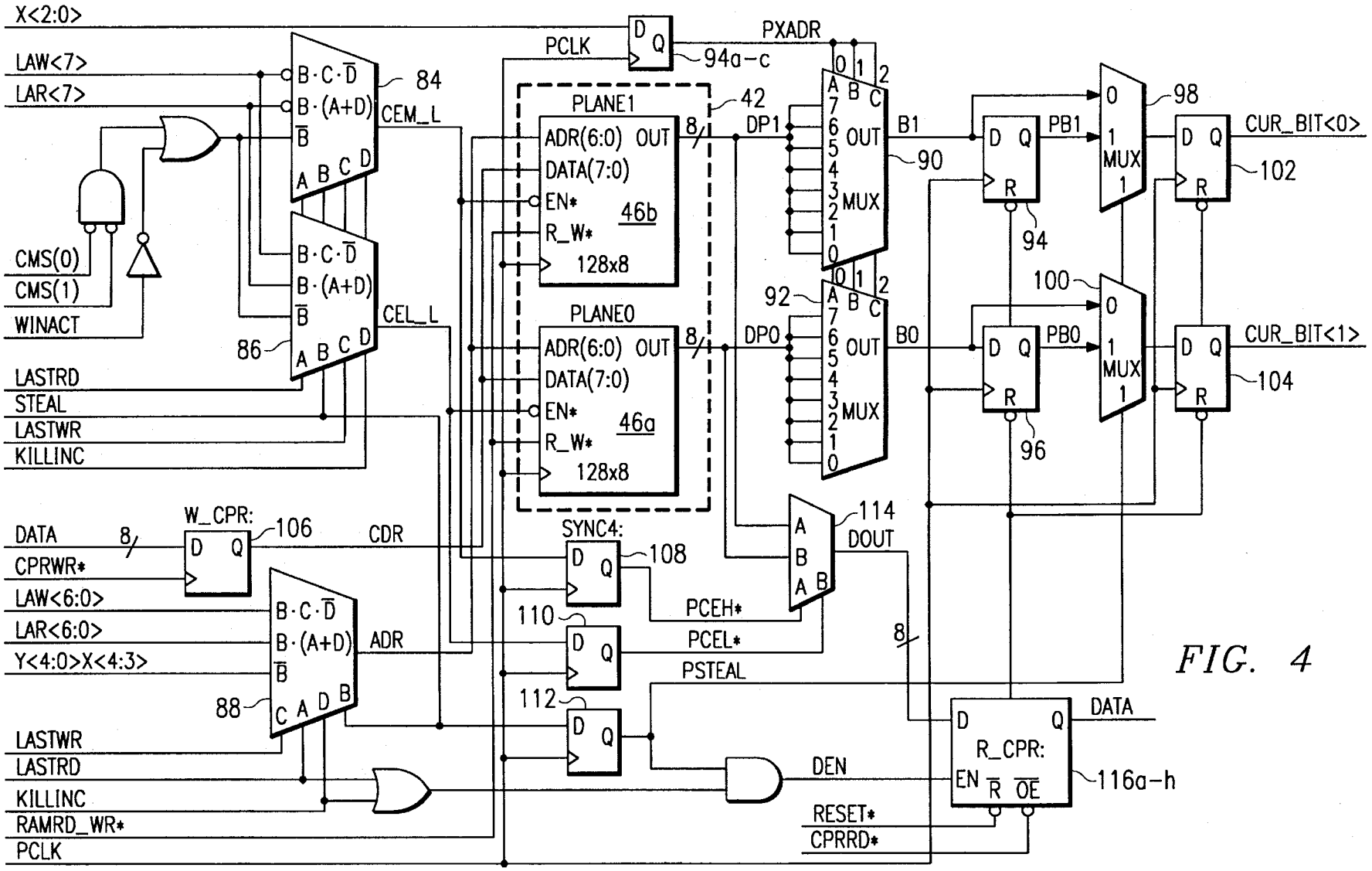
FIG. 4 is an electrical schematic diagram showing a second portion of the cursor generator of FIG. 2.

Selected bits from XADR and YADR are sent to the circuitry of FIG. 4 to address RAM 42 and retrieve the corresponding register select bits CUR_BIT0 and CUR_BIT1 for the current pixel. In the illustrated embodiment, when a 32×32×2 architecture RAM 42 is being used, bits $X_3$-$X_4$ are taken as the LSBs and bits $Y_0$-$Y_4$ taken as the MSBs for the address to RAM 42. It should be noted that while CUR_EN is only generated when the current pixel falls within the location on screen 36 where cursor 40 is being displayed, XADR and YADR are constantly being generated in the active window 41 and provided to RAM 42 to address a series of "phantom cursors" which underlie the current graphics or video data being displayed.

To understand the addressing/data retrieval circuitry of FIG. 4, the input signals will first be briefly described. Address Y<4:0>X<4:3> is the address composed of bits $X_3$-$X_4$ of XADR and bits $Y_0$-$Y_4$ of YADR for retrieving a pair of bytes of (one byte from each plane of $RAM_{42}$) register select bits from $RAM_{42}$. Control signal X<2:0> is composed of bits $X_0$-$X_2$ of XADR and is used to select a pair of bits CUR_BIT0 and CUR_BIT1 from the pair of eight bit bytes simultaneously retrieved from RAM 42. Addresses LAW<6:0> and LAR<6:0> are the 7 LSBs of respective 8 bit addresses LAW<7:0> and LAR<7:0> provided by the system processor 20 to address locations in a selected plane of RAM 42 when the register select bits CUR_BIT0 and CUR_BIT1 defining the desired form (pattern) of the cursor 40 is being written in or read out. Bits LAW<7> and LAR<7> are the MSBs of with LAW<7:0> and LAR<7:0> respectively and are used to select between Plane 0 and Plane 1 of RAM 42 during writes and reads of register select bits (words). Control signal KILLINC controls the incrementation of the counters (not shown) generating LAR and LAW. Signal RAMRD_WR* designates whether a read or write to RAM 42 is being performed. CMS(0) and CMS(1) designate whether an interlaced or noninterlaced display 14 is being driven. WINACT designates that the cursor is within the active window, as previously described above. Control signal STEAL is used for anti-sparkling, described further below, where data for the previous pixel is carried forward for use as the current pixel while a write into RAM 42 is performed. DATA is the cursor pattern from the host processor 20 being loaded into RAM 42 by host processor 20, with CPRWR* being the associated write signal from processor 20. LASTWR indicates that the last input/output operation was a write to RAM 42. LASTRD indicates that the CPRRD* or LARWR* occurred during the last input/output operation.

In the illustrated embodiment, RAM 42 is a two plane dual port RAM including a data port for reading and writing to and from system processor 20 and an output port (OUT) for delivering register select bits to multiplexing circuitry 32. A pair of multiplexers 84 and 86 are provided to control the enabling/selection of RAM planes 46*a* and 46*b*. An associated multiplexer 88 selects between retrieval address Y<4:0>X<4:3>, a write address LAW<6:0> and a read address LAW<6:0>. In the mode where register select bits are being retrieved and output from the OUTPUT ports (OUT), STEAL is inactive (in the illustrated embodiment low) and the register select bit retrieval addresses Y<4:0>X<4:3> are selected by multiplexer 88 and provided to the address ports ADR(6:0) for both RAM planes 46*a* and 46*b*. In the active display window 41 (FIG. 2) (WINACT active), both planes 46*a* and 46*b* are enabled by multiplexers 84 and 86 respectively. In a deinterlaced system planes 46*a* and 46*b* are enabled for every line of the cursor 40 pixel array and in an interlaced system for every line of the current odd or even field, as controlled by 0_E* input. The addressed 8-bit bytes are then clocked out with the next PCLK. CMS(0) and CMS(1) are control signals which when "00" disable access to the cursor pattern RAM 42 for power conservation. When CMS(0), CMS(1) equals 01 a two color cursor is provided, when CMS(0), CMS(1) equals 10 a two color cursor with highlight is provided, and when CMS(0), CMS(1) equals 11 a three color cursor is provided. Similarly, when WINACT is low, the access to cursor RAM 42 is disabled for power consumption.

The bytes of data output from planes 46*a* and 46*b* are provided at the eight data inputs to a corresponding pair of multiplexers 90 and 92. The pair of bits CUR_BIT0 and CUR_BIT1 for the current pixel are selected from the retrieved bytes by mutltiplexers 90 and 92 in accordance with bits X<2:0> of XADR (labeled PXADR following pipelining with PCLK by flip-flops 94*a*–*c*). The pair of selected bits output from multiplexers 90 and 92 are latched by a corresponding pair of flip-flops 94 and 96 with the PCLK and also sent directly to the first set of inputs (the "0" inputs) of a corresponding pair of multiplexers 98 and 100. The bits output (PB0 and PB1) from flip-flops 94 and 96 are passed on to the second data inputs (the "1" inputs) of multiplexers 98 and 100. During a normal retrieval when STEAL is inactive, the data sent directly to the 0 inputs of multiplexers 98 and 100 is selected. When STEAL is active, as discussed further below, the bits latched at the outputs of flip-flops 94 and 96 (PB0 and PB1) are selected and passed to latches 102 and 104 (such that the bits for the previous pixel are being used). Latches 102 and 104 pipeline the bits output from multiplexers 98 and 100 with PCLK thereby providing bits CUR_BIT0 and CUR_BIT1.

RAM 42 is accessed in a planar format with plane 46*a* (plane 0) holding all values for CUR_BIT(0) and plane 46*b* (plane 1) holding all values for CUR_BIT(1) during a write or read by system processor 20. Eight bit positions (one byte position) are accessed from the plane designated by LAW<7> and LAR<7>. Write and read addresses LAW<7:0> and LAR<7:0> are generated by a corresponding pair of binary address counters (not shown) which increment automatically after an access. Any write to the write address counter after cursor auto-increment has been initiated resets the auto-increment logic until RAM 42 has been addressed again. Cursor auto-incrementing then begins from the address written. A read from the read address counter does not reset the cursor. In FIG. 4, the control signal KILLINC indicates that auto-incrementation has been interrupted.

During a write into planes 46*a* and 46*b*, STEAL is active such that multiplexers 98 and 100 select the previous bit latched by flip-flops 94 and 96 to control sparkle (i.e., a write into RAM 42 can be made on-the-fly). At the same time, LASTWR and KILLINC are active indicating that the write cycle to the locations of RAM 42 has not been completed and that incrementing of the write address counter is continuing. The location address LAW<6:0> is thus selected by multiplexer 88 and provided to the address inputs of both planes 46*a* and 46*b*. At the same time, multiplexers 84 and 86 pass bit LAW<7> which determines which plane 46 will be written into. RAMRD_WR* is set low to select the write mode. The data to be written in is provided from the system processor 20 through latch 106 and the write occurs with the next PCLK. In this fashion, the cursor array can be modified to change the pattern (shape) of the displayed cursor 40.

During a read, STEAL is again active such that multiplexers 98 and 100 select the previous bit latched by flip-flops 94 and 96 to control sparkle. The location address LAR<6:0> is thus selected by multiplexer 88 and provided to the address inputs of both planes 46*a* and 46*b*. At the same time, multiplexers 84 and 86 pass bit LAR<7> which determines which plane 46 will be written into. RAMRD_WR* is set low to select the write mode. The read occurs with the pixel clock (PCLK). The STEAL, and the outputs of multiplexers 84 and 86 (CEW_L and CEL_L respectively) are synchronized with the data output from RAM 42 by flip-flops 108, 110, and 112. The outputs of multiplexers 84 and 86 are then used by multiplexer 114 to select the outputs of the plane 46*a* or 46*b* being read from. The read-out data is latched by flip-flops 116*a–h* for output.

Although the present invention and its advantages have been described in detail, it should be understood that various changes, substitutions and alterations can be made herein without departing from the spirit and scope of the invention as defined by the appended claims.

What is claimed is:

1. Circuitry for controlling the display position of a cursor on a display operable to display information as at least one field of a plurality of lines of pixels, comprising:

first counter circuitry operable to increment with each of a plurality of selected pixels of a said line;

first storage circuitry operable to store position data representing a first coordinate of a reference pixel in said field, said reference pixel associated with an area of said field in which said cursor is to be displayed;

first adding circuitry operable to add a count corresponding to a current pixel output from said first counter to said position data in said first storage circuitry;

second counter circuitry operable to increment with each line of said field;

second storage circuitry operable to store position data representing a second coordinate of said reference pixel;

second adding circuitry operable to add a count corresponding to said current pixel output from said second counter to said position data in said second storage circuitry; and comparator circuitry operable to compare an output of said first adding circuitry and an output of said second adding circuitry to a predetermined value and in response output an enable signal when said current pixel is within said area of said field in which said cursor is to be displayed.

2. The circuitry of claim 1 wherein said first coordinate comprises an x-position coordinate and said second coordinate comprises a y-position coordinate.

3. The circuitry of claim 1 wherein said reference pixel comprises a first pixel in a first row of said area.

4. The circuitry of claim 1 and further comprising circuitry for translating said reference pixel from a first position in said area to a second position in said area.

5. The circuitry of claim 4 wherein said circuitry for translating is operable to add a selected number of bits to said position data held in said first and second storage circuitry.

6. The circuitry of claim 5 wherein said first and second storage circuitry comprise registers.

7. The circuitry of claim 1 and further comprising inverter circuitry operable to invert said position data in said first and second storage circuitry prior to addition with said counts output from said first and second counter circuitry.

8. The circuitry of claim 1 wherein said comparator circuitry is operable to determine whether said current pixel is within said area by comparing at least one most significant bit of said output from said first adding circuitry and at least one most significant bit of said output from said second adding circuitry to said predetermined value.

9. The circuitry of claim 1 wherein said comparator circuitry outputs said enable signal when selected bits of said count output from said first adding circuitry and selected bits of said count output from said second adding circuitry are equal to a logical zero.

10. The circuitry of claim 9 wherein said selected bits of said output from said first adding circuitry comprise most significant bits.

11. The circuitry of claim 10 wherein said selected bits of said count output from said second adding circuitry comprise most significant bits.

12. The circuitry of claim 1 wherein said window comprises a cursor.

13. The circuitry of claim 1 wherein said second counter circuitry is operable to increment by two when said display is operating is an interlaced mode and said at least one field comprises a selected one of said an odd and an even field.

14. The circuitry of claim 1 wherein said selected pixels of a said line comprise all the pixels of the said line.

15. The circuitry of claim 1 wherein said selected pixels of a said line comprise pixels displayed during an active period of the said line.

16. Circuitry for providing a color pattern for an array of pixels in a selected area of a screen of a display device operable to display information as a field of lines of pixels, a start of display of said field corresponding to a vertical sync signal, a start of display of each said line corresponding to a horizontal sync signal, and display of each pixel corresponding to a period of clock, comprising:

data storage for holding color data words, each said word stored at a location associated with a select word;

circuitry for outputting a selected said color data word from said data storage in response to a said select word and an enable word;

a memory circuitry for holding an array of said select words defining said color pattern, each said select word associated with an address; and control circuitry for selectively generating a said enable word and a said memory address comprising:

an x-position counter for incrementing with said periods of said clock during an active window following each said horizontal sync signal;

an x-position register holding x-position data corresponding to an x-position of a reference pixel in said selected area;

an x-position adder for adding a count output for a current pixel from said x-position counter to the inverse of said x-position data in said x-position register, a word output from said x-position adder forming a portion of the said memory address for said current pixel;

a y-position counter for incrementing with said active windows following said vertical sync signal;

a y-position register holding y-position data corresponding to said reference pixel;

a y-position adder for adding a count output for said current pixel from said y-position counter to the inverse of said y-position data in said y-position register, a word output from said y-position adder forming a portion of said at least one memory address for said current pixel; and a comparator for comparing at least one most significant bit of said word output from said x-position adder and at least one most significant bit of said word output from said y-position adder to a predetermined value and selectively outputting a said enable word for said current pixel in response.

17. The circuitry of claim 16 wherein said data storage comprises a plurality of registers.

18. The circuitry of claim 16 wherein said circuitry for outputting includes multiplexing circuitry.

19. The circuitry of claim 16 wherein each said select word is composed of a plurality of bits, each said one of said plurality of bits stored in a respective bit plane in said memory.

20. The circuitry of claim 19 wherein said array of pixels is arranged as m lines of n pixels each and each of said bit planes comprises an array of bit storage locations arranged as m rows and n columns.

21. The circuitry of claim 16 wherein a plurality of said select words are stored in a location in a memory associated with a said address, said memory circuitry accessing said plurality of select words in said memory with each said address from said control circuitry.

22. The circuitry of claim 21 wherein said memory circuitry is operable to provide to said outputting circuitry a said select word from said plurality of select words as indicated by selected bits of said count output by said x-position adder.

23. The circuitry of claim 16 wherein said comparator outputs said enable word when both said at least one most significant bit of said count output from said x-position adder and said at least one most significant bit of said count output from said y-position adder are equal to zero.

24. The circuitry of claim 21 wherein said plurality of select words comprise at least one byte.

25. Apparatus for displaying a cursor at a preselected position on a screen of pixels comprising:

means for determining an x-position on said screen of a current one of said pixels and providing current x-position data in response;

means for storing reference x-position data representing an x-position of a reference pixel associated with an area of said screen in which said cursor is to be displayed;

means for subtracting said stored reference x-position data from said current x-position data and providing a first result word in response;

means for determining a y-position on said screen of said current pixel and providing current y-position data in response;

means for storing reference y-position data representing a y-coordinate of said reference pixel;

means for subtracting said stored reference y-position data from said current y-position data and providing a second result word in response; and means for enabling display of said current pixel with color data associated with said cursor in response to a comparison of selected bits of said first result word and selected bits of said second result word with a predetermined value.

26. The apparatus of claim 25 wherein said means for determining an x-position comprises a counter.

27. The apparatus of claim 25 wherein said means for determining a y-position comprises a counter.

28. The apparatus of claim 25 wherein said means for storing reference x-position data comprises a register.

29. The apparatus of claim 25 wherein said means for storing reference y-position data comprises a register.

30. The apparatus of claim 25 wherein said means for subtracting said stored reference x-position data from said current x-position data comprises an adder.

31. The apparatus of claim 25 wherein said means for subtracting said stored reference y-position data from said current y-position data comprises an adder.

32. The apparatus of claim 25 wherein said means for enabling comprises a comparator.

33. A display system comprising:

a display for displaying information as a field of pixels arranged as a plurality of lines, the start of display of said field corresponding to a first control signal, the start of display of each line corresponding to a second control signal, and display of each pixel timed with a period of a clock comprising:

digital to analog conversion circuity for generating analog color signals defining the color of a said pixel in said field from a corresponding digital color data word;

a plurality of registers each for holding a said color data word;

multiplexing circuitry for passing a said color data word from a selected one of said registers to said conversion circuitry in response a register select word and an enable word;

a memory for holding an array of said register select words defining a color pattern of a cursor to be displayed in a selected portion of said field, each said register select retrievable by a corresponding memory address; and control circuitry for selectively generating said enable word and a said memory address for a current pixel comprising:

an x-position counter for incrementing with said periods of said clock during an active portion of each said line;

an x-position register holding x-position data corresponding to an x-position of a reference pixel of said field, said reference pixel associated with an area of said field in which said cursor is to be displayed;

an x-position adder for adding a count output from said first counter for said current pixel to said x-position data from said x-position register, an output of said x-position adder forming a portion of said one memory address for said current pixel;

a y-position counter for incrementing with each said line during an active portion of said field;

an y-position register holding y-position data indicating a y-position of a said reference pixel;

a y-position adder for adding a count output from said y-position counter for said current pixel to said y-position data from said y-position register, an output of said y-position adder forming a portion of said memory address for said current pixel; and a comparator for comparing selected bits of said count output by said x-position adder to a predetermined value and selected bits of said count output said y-position adder and selectively outputting said enable word in response.

34. The system of claim 33 wherein said display system comprises a raster scan display.

35. The system of claim 33 wherein said display is operable to display in an RGB format.

36. A method for displaying a cursor at a preselected position on a screen of pixels comprising:

determining an x-position on the screen of a current one of the pixels and providing current x-position data in response;

storing reference x-position data representing an x-position of a reference pixel associated with an area of the screen in which the cursor is to be displayed;

subtracting the stored reference x-position data from the current x-position data and providing a first result word in response;

determining a y-position on the screen of the current pixel and providing current y-position data in response;

storing reference y-position data representing a y-coordinate of the reference pixel;

subtracting the stored reference y-position data from the current y-position data and providing a second result word in response; and enabling display of the current pixel with color data associated with the cursor in response to a comparison of selected bits from the first result word and selected bits from the second result word with a predetermined value.

37. The method of claim 36 wherein said step of enabling comprises the substep of:

comparing at least one most significant bit in the first result word and at least one most significant bit in the second result word to zero and enabling display of the current pixel with color data associated with the window when the most significant bits are equal to zero.

* * * * *